US007080469B2

(12) United States Patent
Ganswich

(10) Patent No.: US 7,080,469 B2
(45) Date of Patent: Jul. 25, 2006

(54) MULTIPLE-TOOL ATTACHMENT FOR VEHICLES

(76) Inventor: William G. Ganswich, 6130 Woodland Dr., Ogden, UT (US) 84403

( * ) Notice: Subject to any disclaimer, the term of this patent is extended or adjusted under 35 U.S.C. 154(b) by 235 days.

(21) Appl. No.: 10/162,166

(22) Filed: Jun. 3, 2002

(65) Prior Publication Data

US 2003/0221340 A1 Dec. 4, 2003

(51) Int. Cl.
*E02F 3/00* (2006.01)

(52) U.S. Cl. ..... 37/405; 37/406; 37/403

(58) Field of Classification Search ..... 37/403, 37/404, 405, 943, 466; 414/685, 690, 694, 414/912; 290/423, 402
See application file for complete search history.

(56) References Cited

U.S. PATENT DOCUMENTS 3,351,221 A * 11/1967 Smalley ..... 414/694
3,989,149 A * 11/1976 Smith et al. ..... 414/694
4,408,949 A * 10/1983 Witty ..... 414/694
4,925,358 A * 5/1990 Cook ..... 414/685
5,015,147 A * 5/1991 Taylor et al. ..... 414/685
6,065,621 A * 5/2000 Fatemi et al. ..... 212/301

* cited by examiner

*Primary Examiner*—Meredith Petravick
(74) *Attorney, Agent, or Firm*—Fehr Law Firm; Thompson E. Fehr

(57) ABSTRACT

A multiple-tool attachment for vehicles having a front subassembly and a rear subassembly. The front subassembly and rear subassembly are connected with a slip joint so that the attachment can be placed upon vehicles of varying size. A variety of tools can be connected to the front subassembly. Preferably the front subassembly has one or more support wheels, and one embodiment of the rear subassembly has one or more rear support wheels. Such wheels can support the weight of the attachment and tools to minimize the added load on a vehicle. In another embodiment, the rear subassembly is replaced with an adapter so that the front subassembly can be connected to a truck or utility vehicle. And a still further embodiment, in order to facilitate towing, adds tow wheels to the embodiment having the front subassembly but with an adapter replacing the rear subassembly.

94 Claims, 13 Drawing Sheets

MULTIPLE-TOOL ATTACHMENT FOR VEHICLES

BACKGROUND OF THE INVENTION

1. Field of the Invention

This invention relates to a device for attaching a variety of tools to vehicles.

2. Description of the Related Art

A number of patents have been issued for devices which attach tools to vehicles.

U.S. Pat. No. 5,674,046 is for is termed a "Multiple Construction Equipment Attachment." It is specifically stated to be for allowing a vehicle to serve as a snow plow, front end loader, or fork lift. This device, however, appears to be incapable of assisting in supporting its own weight while the associated vehicle is moving and is built as a single section or assembly.

U.S. Pat. No. 5,511,329 is a "Backhoe Mounting Mechanism." Again, it appears to be incapable of assisting in supporting its own weight while the associated vehicle is moving and is built as a single section or assembly.

A "Hinged Plow Attachment" is the subject of U.S. Pat. No. 6,035,944. Once more, though, it appears to be incapable of assisting in supporting its own weight while the associated vehicle is moving (or even when the vehicle is not moving) and is built as a single section or assembly.

U.S. Pat. No. 5,088,215 covers only a plow. It is shown attached to an all-terrain vehicle. All the weight of the plow is, however, supported by the vehicle; and no provision is made for an attachment device built in more than one section or assembly.

U.S. Pat. No. 5,615,745 illustrates a blade on an all-terrain vehicle. Again, however, all the weight of the plow is supported by the vehicle; and no provision is made for an attachment device built in more than one section or assembly.

U.S. Pat. No. 6,178,668 has a structure which extends under a vehicle. Attached to one end of the structure is some form of "motorized implement"; attached to the other end of the structure is a power source to operate the "motorized implement." (The figures only show the structure attached to an all-terrain vehicles and only illustrate a snowblower as the "motorized implement.") The ground-engaging support member (caster wheels or skis) are located near the first end of the structure. The structure is attached to the frame of the vehicle at points intermediate between the first end and the other end of the structure. Since the weight of the power source is situated such that there is no ground-engaging support between the location of the power source and the points of attachment of the structure to the frame of the vehicle, the vehicle will support at least the weight of the power source. And, as with the devices of the preceding patents, no provision is made for an attachment device built in more than one section or assembly.

Additionally, there are two devices related to the present invention that are apparently in production but for which the Inventor could locate no patent.

The BeaverPro QH50 of L. B. Manufacturing, 77 Champlain Street, Dieppe, N. B., Canada E1A 1N5 can mount tools to an ATV in one version and to a truck in another version. And the Groundhog ATV Loader made by Concord Environmental Equipment, LLC, 25808 Highway 10, Hawley, Minn. 56549, can add a front-end loader to an ATV. Neither of these two devices, however, appears to have any independent means for supporting the weight of the device or the associated; and neither device is built in more than one section or assembly.

SUMMARY OF THE INVENTION

The present Multiple-tool Attachment for Vehicles is constructed with a front subassembly of an assembly and a rear subassembly of the assembly. The front subassembly and the rear subassembly are connected to one another with a slip joint so that the length of the assembly can be adjusted to fit any vehicle.

The tools are attached to the front subassembly, as also preferably is a control panel.

Thus, with the rear subassembly removed, an adapter can be placed into the end of the front subassembly which is otherwise attached to the rear subassembly. This adapter permits the front subassembly to be connected to a traditional receiver mounted on the rear of a truck, sport-utility vehicle, or the like and thereby function independently from the rear subassembly. When this is done, an optional seat is also preferably attached to the front subassembly.

Furthermore, the front subassembly of the Attachment has one or more support wheels located near its front end; and, in one embodiment, the rear subassembly has one or more support wheels located near its rear end. In this embodiment, therefore, the assembly of the Attachment supports the full weight of any tool or other item connected to the assembly.

DESCRIPTION OF THE PREFERRED EMBODIMENT

Figure 1:
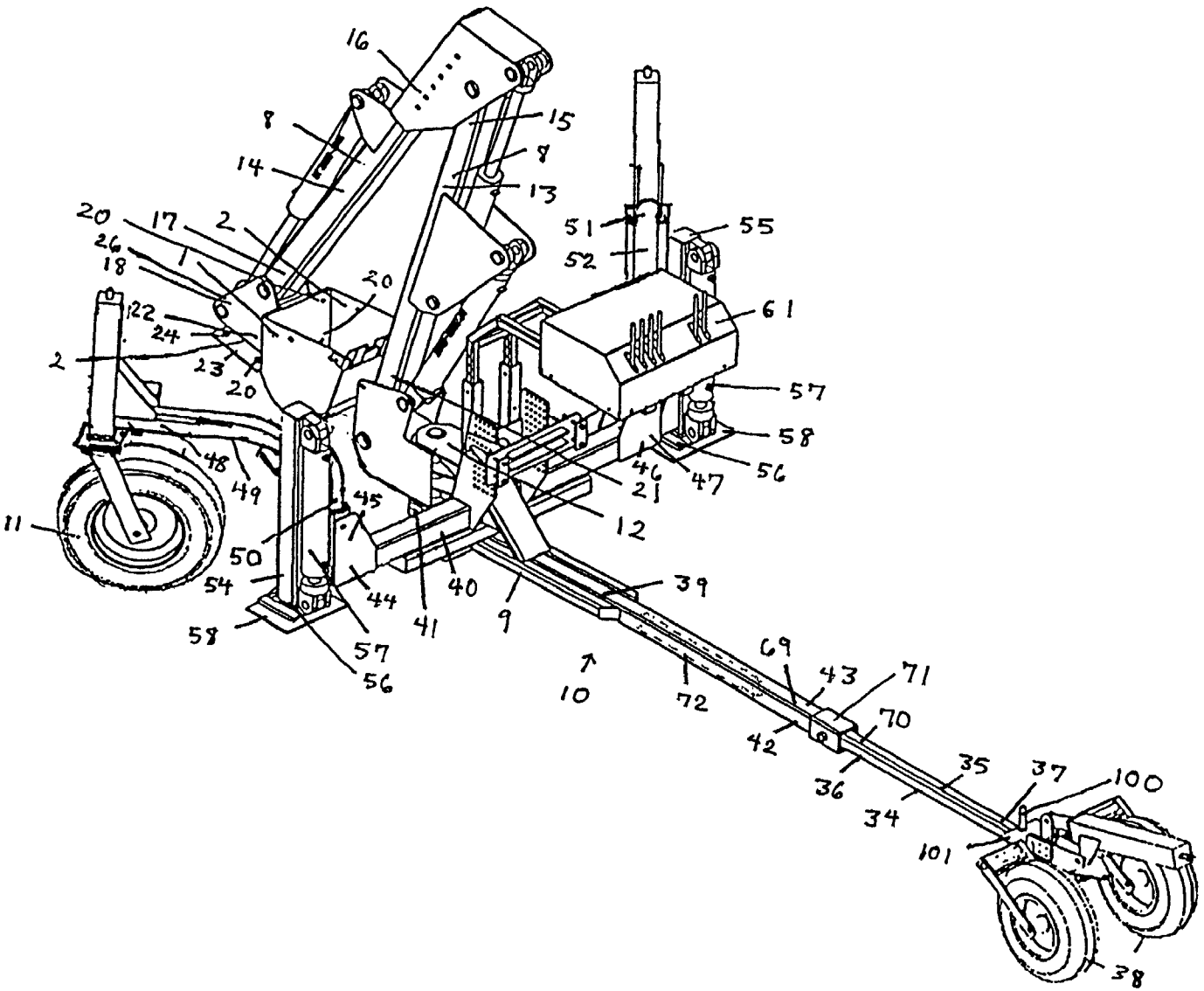
FIG. 1 shows the Multiple-tool Attachment for Vehicles with both the inner section and the outer section of a boom attached to the front subassembly.
Figure 2:
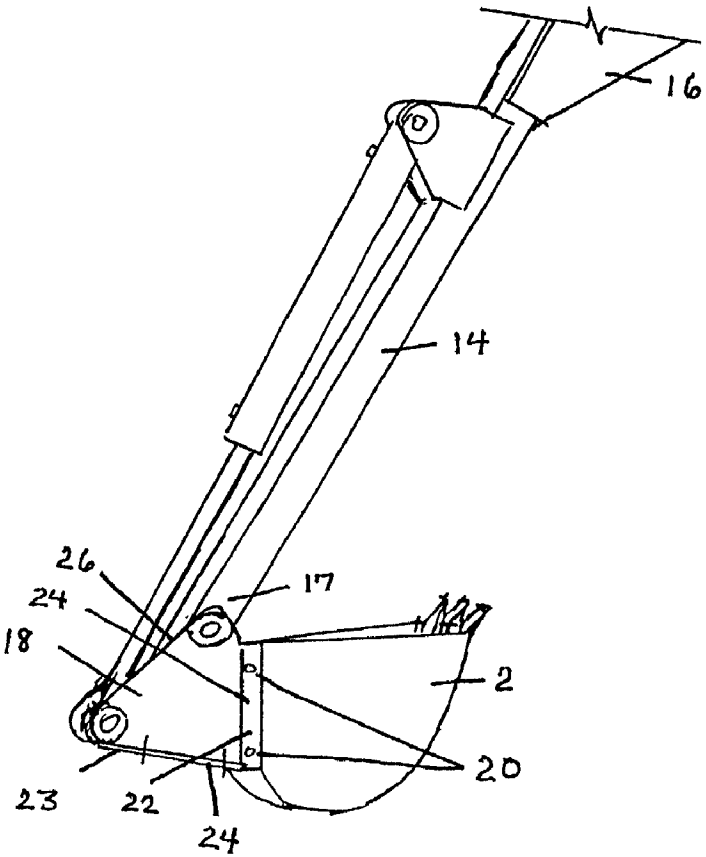
FIG. 2 depicts a backhoe bucket attached to the outer section of a boom.
Figure 3:
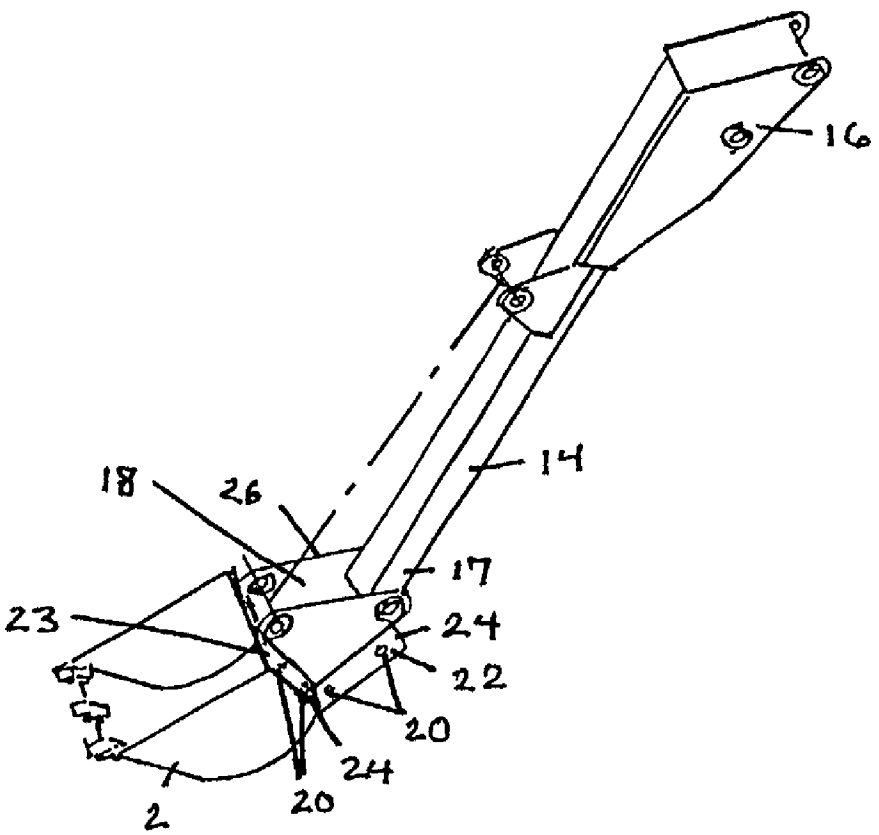
FIG. 3 illustrates the bucket reversed and attached to the outer section of the boom to be used as a shovel.
Figure 4:
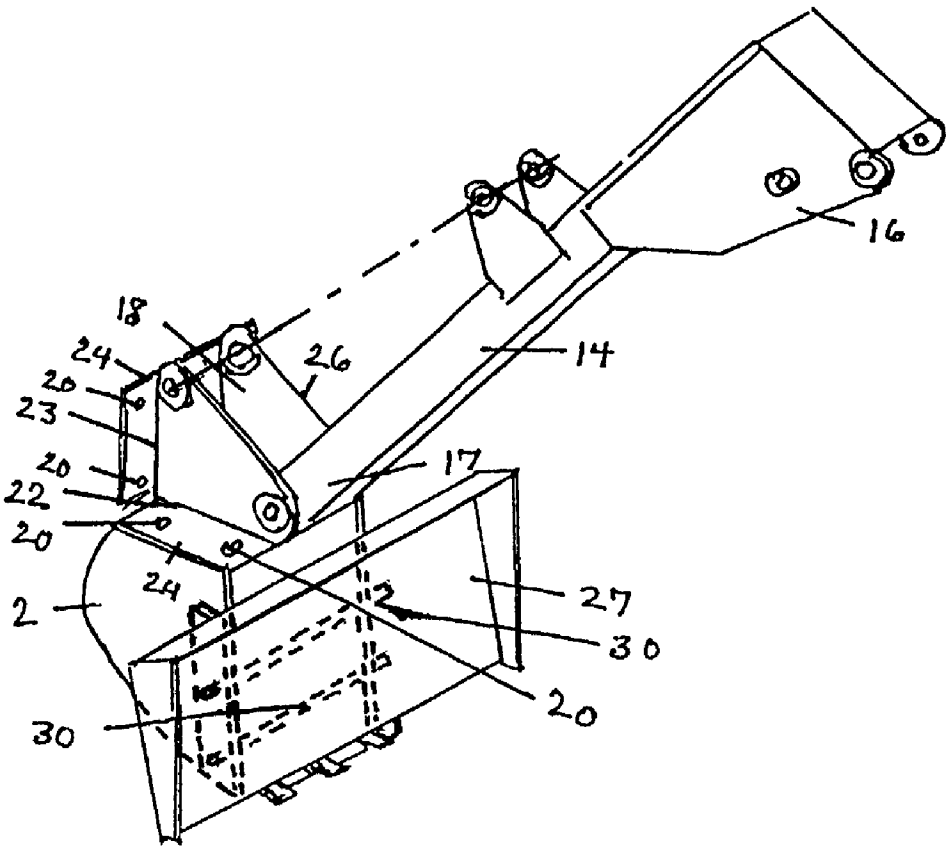
FIG. 4 is a view of a backfill blade connected to the backhoe bucket.
Figure 5:
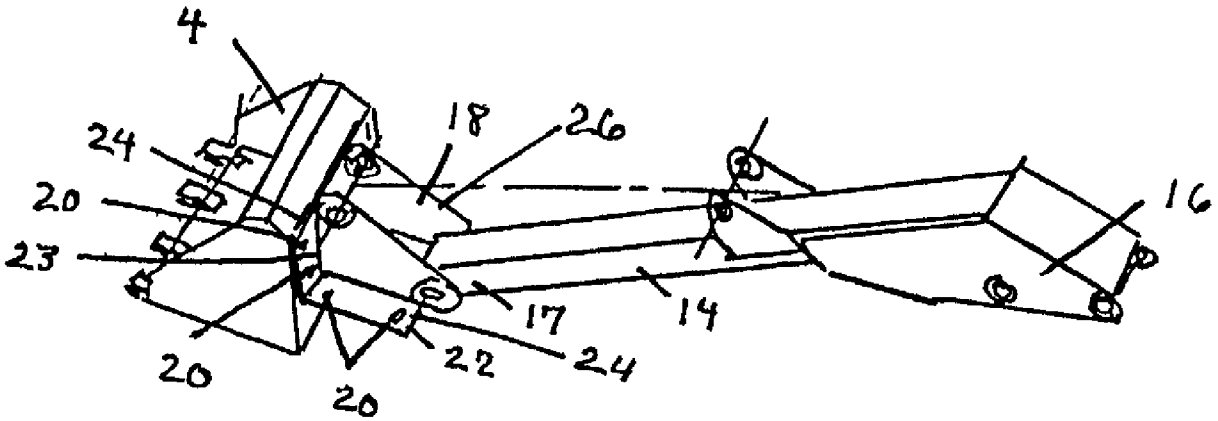
FIG. 5 shows a front-loader bucket attached to the outer section of the boom.
Figure 6:
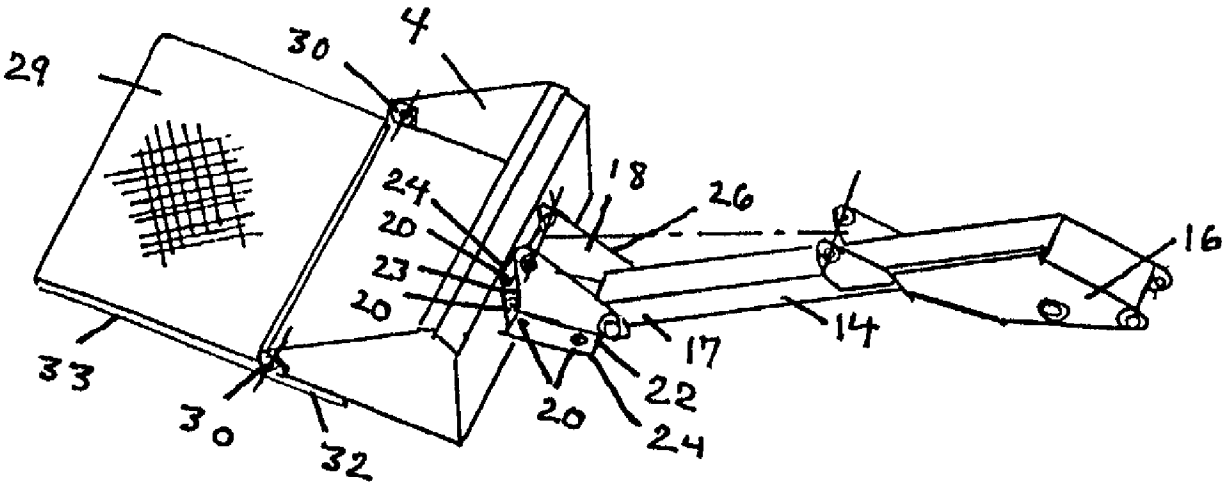
FIG. 6 depicts a cantilever load support attached to a front-loader bucket that is connected to the outer section of the boom.
Figure 7:
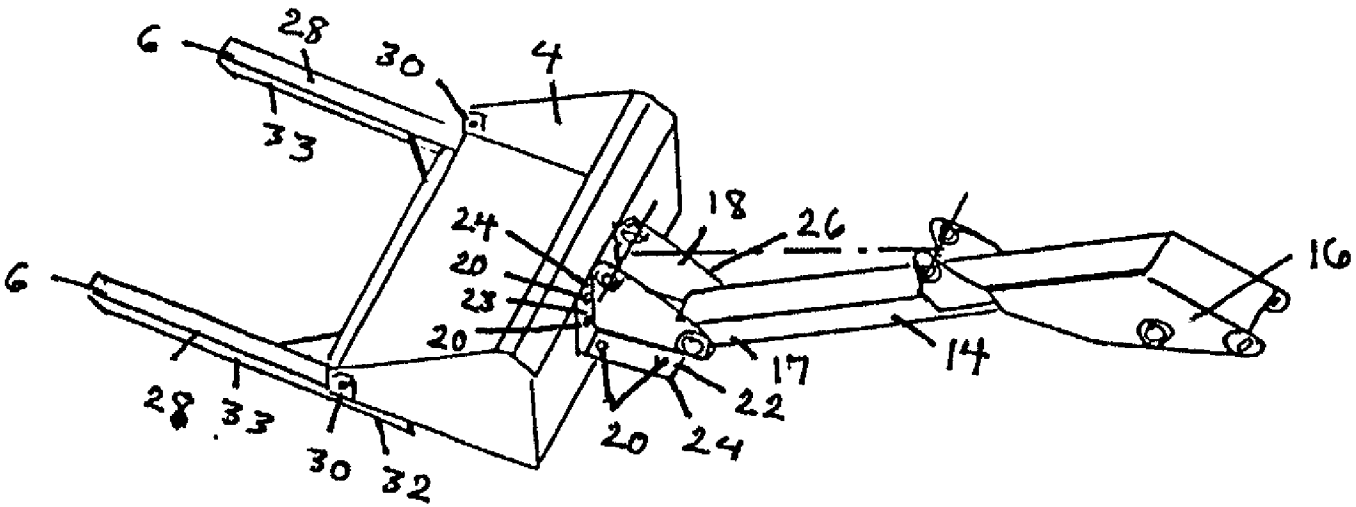
FIG. 7 illustrates a fork load support assembly connected to a front-loader bucket that is attached to the outer section of the boom.
Figure 8:
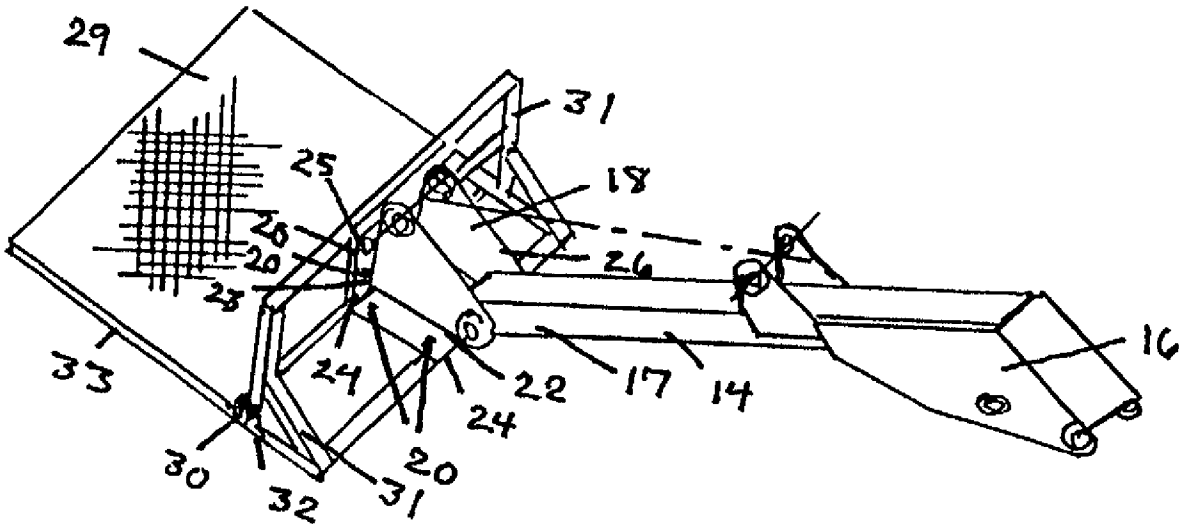
FIG. 8 is a view of a cantilever load support connected with an attachment assembly to an adapter assembly that is connected to the outer section of the boom.
Figure 9:
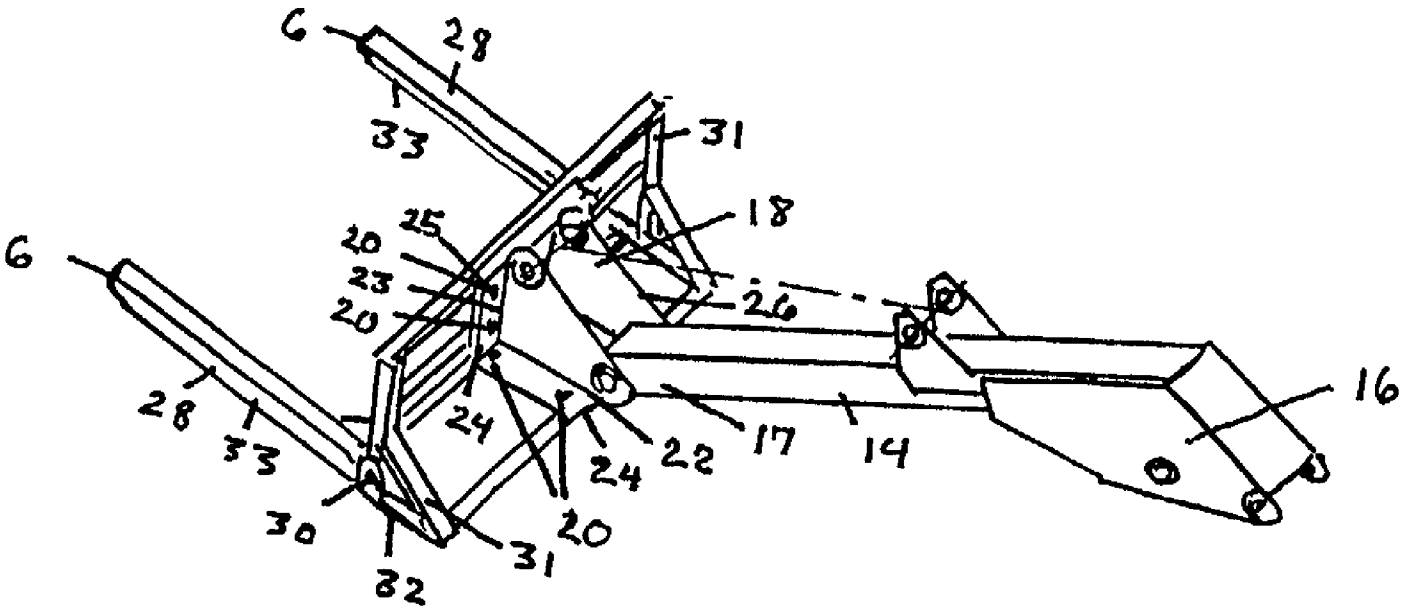
FIG. 9 provides a view of a fork load support assembly connected to an adapter assembly that is attached to the outer section of the boom.
Figure 10:
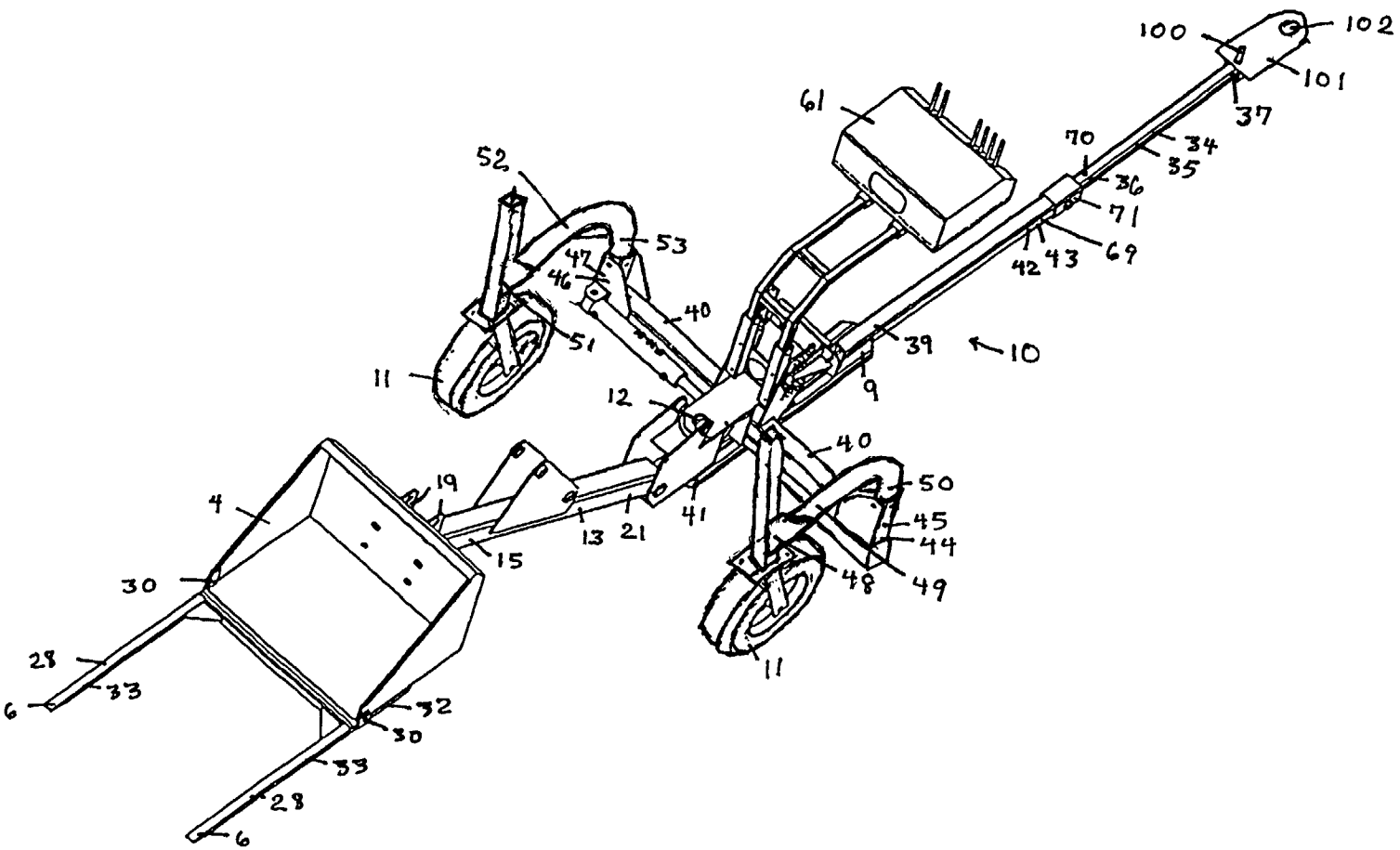
FIG. 10 depicts the Multiple-tool Attachment for Vehicles with a fork load support assembly connected to a front-loader bucket that is attached to the inner section of the boom.
Figure 11:
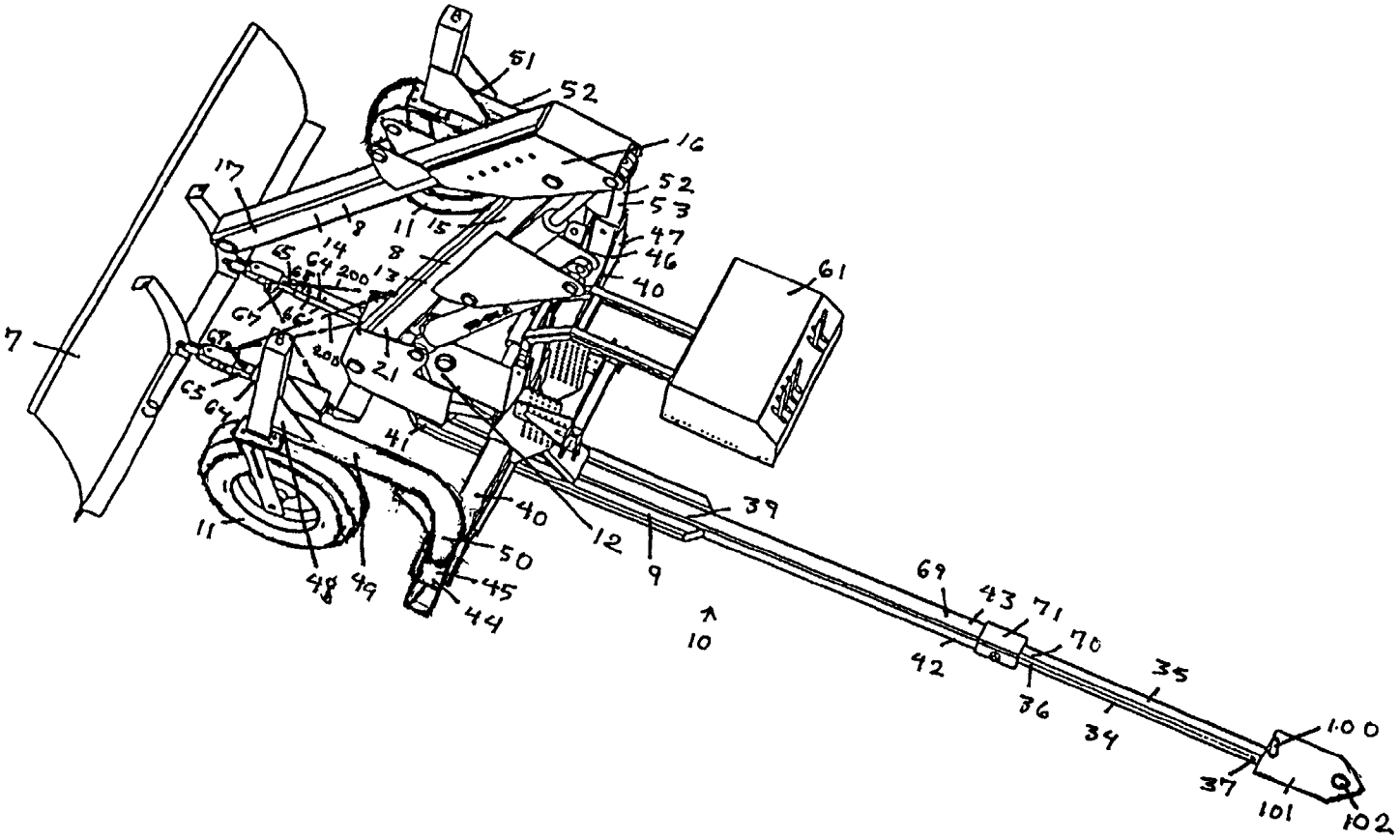
FIG. 11 shows a plow attached to the front subassembly of the assembly for the Multiple-tool Attachment for Vehicles.
Figure 12:
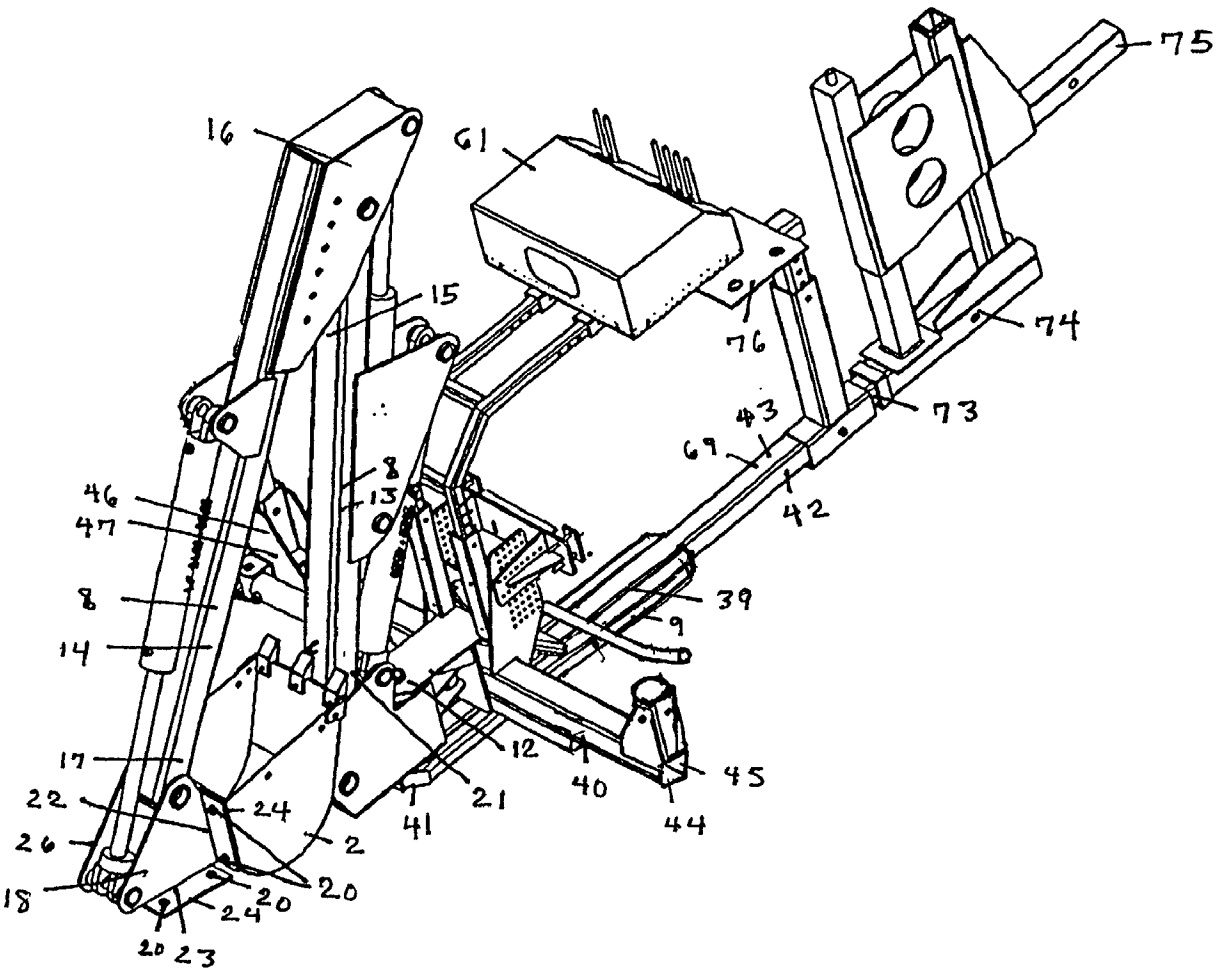
FIG. 12 shows the Multiple-tool Attachment for Vehicles having the rear subassembly removed and replaced with an adapter for connecting the Multiple-tool Attachment for Vehicles to a truck or utility vehicle and also having the support wheels removed.
Figure 13:
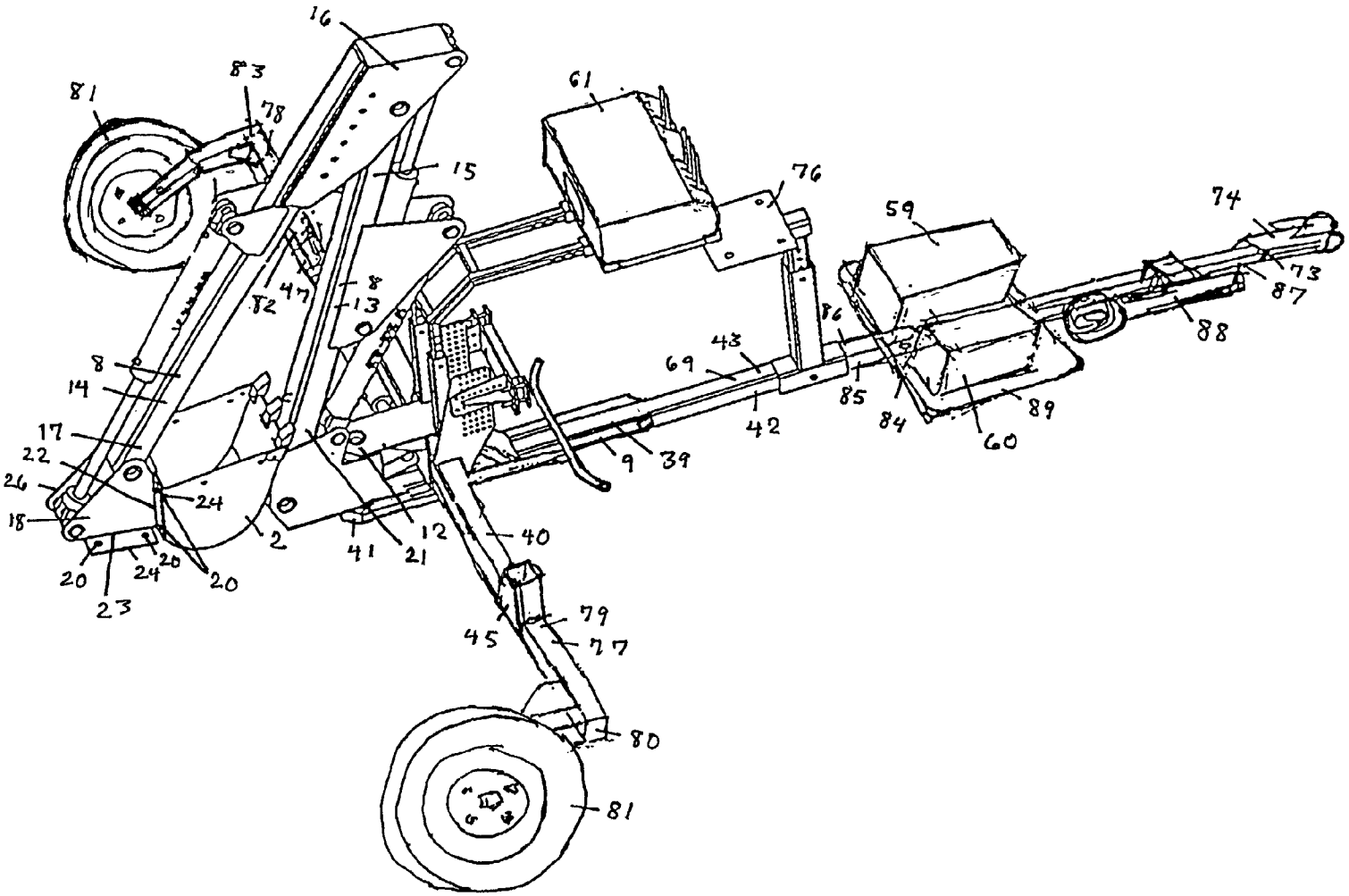
FIG. 13 depicts the Multiple-tool Attachment for Vehicles with tow wheels and a tow assembly.

The Multiple-tool Attachment for Vehicles permits the addition of tools 1, including—but not necessarily limited to—a backhoe bucket 2, a shovel bucket 3, a front-loader bucket 4, a cantilever load support 5, a fork load support assembly 6, and a plow 7, to an all-terrain vehicle (ATV) or other vehicle.

Except for the plow 7, these items are located on a boom 8 connected to the front subassembly 9 of an assembly 10 that is removably attached to the ATV or other vehicle but that preferably also has its own support, preferably caster, wheels 11 which are located near the front 12 of the front subassembly 9 and which, preferably, can be raised or lowered through any method that is well known in the art.

The boom 8 has an inner section 13 and an outer section 14. The first end 15 of the inner section 13 of the boom 8 is pivotally and, preferably, removably connected to the second end 16 of the outer section 14 of the boom 8. Tools 1 can be attached to the first end 17 of the outer section 14 of the boom 8 with a first adapter assembly 18; and, when the outer section 14 of the boom 8 has been removed, tools 1 can be attached to the first end 15 of the inner section 13 with a second adapter assembly 19. The pattern of apertures 20 for bolts to connect the tools 1 to the first adapter assembly 18 and to connect the tools 1 to the second adapter assembly 19 are preferably identical.

The second end 21 of the inner section 13 of the boom 8 is attached to the front 12 of the front subassembly 9 of the assembly 10 in any manner that is well known in the art in such a manner that the boom 8 can be rotated in both the pitch axis and the yaw axis. Of course, the front 12 of the front subassembly 10 is adapted, in any manner that is well known in the art, for attachment of the boom 8.

The first adapter assembly 18 has apertures 20 for connecting some tools 1 on a first side 22 and apertures 20 for connecting other tools 1 on a second side 23 of the first adapter assembly 18. The first side 22 and the second side 23 of the first adapter assembly 18 also have slide plates 24 upon which tools 1 may be slid and then retained with a friction bolt 25. The desired action for a given tool 1 will determine whether that tool 1 is fastened to the first side 22 or the second side 23 of the first adapter assembly 18. For example, a backhoe bucket 2 is attached to the first side 22 of the first adapter assembly 18; and a shovel bucket 3 is attached to the second side 23 of the first adapter assembly 18. The third side 26 of the first adapter assembly 18 is utilized to connect the first adapter assembly 18 to the first end 17 of the outer section 14 of the boom 8.

In order to optimize flexibility, the backhoe bucket 2 can be reversed and connected to the second side 23 of the first adapter assembly 18 in order to be used as a shovel. The second adapter assembly 19 is the same as the first adapter assembly 18 except that the third side 26 of the second adapter assembly 19 is adapted to attach the second adapter assembly 19 to the first end 15 of the inner section 13 of the boom 8 while the third side 26 of the first adapter assembly 18 is adapted to attach the first adapter assembly 18 to the first end 17 of the outer section 14 of the boom 8.

Connection of a backfill blade 27, forks 28, and a solid support 29 (such as the cantilever load support 5) to the first adapter assembly 18 or to the second adapter assembly 19 is somewhat more complicated.

The backfill blade 27 is optionally removably connected to the backhoe bucket 2 using quick-release pins 30 that pass through the backfill blade 27 and the backhoe bucket 2.

In order to retain and move cargo, either a substantially solid support 29 or forks 28, preferably in the form of a fork load support assembly 6, are removably attached, preferably with quick-release pins 30, to the front loader bucket 4 or to an attachment assembly 31, which is, itself, directly connected to either the first adapter assembly 18 or the second adapter 19 assembly with a friction bolt 25 after having been slid onto a slide plate 24. A shorter first end 32 of the substantially solid support 29 or of the fork load support assembly 6 extends under the item to which the substantially solid support 29 or fork load support assembly 6 is connected, i.e., under either the front loader bucket 4 or the attachment assembly 31, in order to support the weight on the longer second end 33 of the substantially solid support 29 or of the fork load support assembly 6.

Besides the exemplary tools 1 mentioned above, another—categorical—example of a tool 1 which can be attached to the boom is any standard hydraulically operated tool for construction equipment, such as an auger or log splitter.

The rear subassembly 34 of the Attachment is comprised of an elongate member 35 having a first end 36 and a second end 37. In one embodiment, generally employed only with an ATV, the rear subassembly 34 of the Attachment also has attached to the elongate member 35 one or more support wheels 38, designated the rear support wheels 38, that also can be raised and lowered with respect to the elongate member 35 through any means that is well known in the art. With this embodiment, when the support wheels 11, 38 on both the front subassembly 9 and the rear subassembly 34 have been lowered, such wheels 11, 38 support the weight of the assembly 10 and tools 1 so that the added load on the ATV is minimized. Optionally, a straight bolt 100 is attached to the second end 37 of the rear subassembly 34 as, also optionally, is a plate 101 having an aperture 102 for the attachment of a desired wheeled vehicle such as a trailer.

A longitudinal elongate member 39 and a cross member 40 running across and attached to the longitudinal elongate member 39 comprise the front subassembly 9.

A first end 41 of the longitudinal elongate member 39 constitutes the front or first end 12 of the front subassembly 9, and a second end 42 of the longitudinal elongate member 39 constitutes a second end 43 of the front subassembly 9.

Similarly, a first end 44 of the cross member 40 constitutes a first side 45 of the front subassembly 9; and a second end 46 of the cross member 40 constitutes a second side 47 of the front subassembly 9.

Preferably, a first end 48 of a first arm 49 has one or more support wheels 11, preferably rotatably and preferably removably, attached to it. The second end 50 of this first arm 49 is rotatably, and preferably removably, attached to the first side 45 of the front subassembly 9 of the assembly 10 and can be extended outward from the front subassembly 9 to a maximum angle, preferably forty-five degrees, in order to add greater stability. Similarly, a first end 51 of a second arm 52 has one or more support wheels 11 rotatably, and preferably removably, attached to it. The second end 53 of this second arm 52 is rotatably, and preferably removably, attached to the second side 47 of the front subassembly 9 of the assembly 10 and can be extended outward from the front subassembly 9 to a maximum angle, preferably forty-five degrees. Of course, the first side 45 of the front subassembly 9 of the assembly 10 is adapted rotatably to connect to the first arm 49; and the second side 47 of the front subassembly 9 of the assembly 10 is adapted rotatably to connect to the second arm 52. And, through any means that is well known in the art, the support wheels 11 on the first arm 49 and on the second arm 52 can be raised and lowered with respect to the first arm 49 and the second arm 52.

Preferably, outriggers 54, 55 are also removably attached to the first side 45 of the front subassembly 9 of the assembly 10 and to the second side 47 of the front subassembly 9 of the assembly 10 for providing even further stability. A first outrigger 54 is attached to the first side 45 of the front subassembly 9 of the assembly 10, and a second outrigger 55 is connected to the second side 47 of the front subassembly 9. Again, of course, the first side 45 of the front subassembly 9 of the assembly 10 is adapted to connect to the first outrigger 54; and the second side 47 of the front subassembly 9 of the assembly 10 is adapted to connect to the second outrigger 55.

The bottom 56 of each of these outriggers 54, 55 can optionally be raised or lowered manually, electrically, or hydraulically. Any means that is well known in the art can be used for such raising and lowering. Manual raising and lowering is preferable. And electrical raising and lowering is preferably achieved by removably connecting an electric hand drill to a portion of the outrigger 54, 55, which, using any means that is well known in the art, translates rotational motion of such portion into vertical motion of the bottom 56 of the outrigger 54, 55. Of course, hydraulic raising and lowering utilizes a hydraulic cylinder 57.

Preferably, interchangeable foot pads 58 are removably attached to the bottom 56 of each outrigger 54, 55 and permit the outriggers 54, 55 to be used in a variety of soil conditions to brake and stabilize the Attachment and the vehicle.

When the assembly 10 is employed on an ATV, an engine 59 to power the tools 1 and an oil tank 60 are located away from both the exhaust system of the ATV and areas where dust is likely to be generated; an acceptable position is on the top rear of the ATV, although another acceptable location would be a cantilevered one even farther to the rear. Pneumatic or hydraulic hoses running from the oil tank 60 to any tool 1, preferably employing quick disconnects, are then able to be relatively short because they run near the top of the ATV.

Preferably, a control panel 61 for each tool is also attached to the front subassembly 9 and, using any technique that is well known in the art, is adapted to communicate with any tool 1 connected to the front subassembly 9.

The plow 7 is rotatably held to the front 12 of the front subassembly 9 with two beams 62, 63, each of which is composed of an outer portion 64 and an inner portion 65. The inner portion 65 can be extended from and releasably held by the outer portion 64, for example, by having a series of apertures 66 in the outer portion 64 alignable with a series of apertures 67 in the inner portion 65 so that a pin 68 can be placed in a given aperture 66 of the outer portion 64 and extend into a selected aperture 67 of the inner portion 65 thereby enabling each beam 62, 63 to be of two or more lengths. This permits the angle of the plow 7 to be changed in the yaw axis since the two beams 62, 63 are substantially horizontally aligned with one another. Wires 200 attached to the plow 7 and to the inner section 13 of the boom 8 permit the plow to be lowered by moving the inner section 13 of the boom 8 forward and raised by drawing the inner section 13 of the boom 8 backward.

As discussed above, when one or more rear support wheels 38 are employed on the assembly 10, such wheel or wheels 38 are attached to the elongate member 35 of the rear subassembly 34 and provide the primary weight support in the rear of the assembly 10 and the ATV. All other items discussed so far are connected to the front subassembly 9.

The portion 69 of the front subassembly 9 that connects to the rear subassembly 34, which portion 69 is the second end 43 of the front subassembly 9, is preferably hollow so that the connecting portion 70 of the rear subassembly 34, which connecting portion 70 is the first end 36 of the rear subassembly 34, slides into the connecting portion 69 of the front subassembly 9. A slip joint 71 holds the rear subassembly 34 to the front subassembly 9, permitting various lengths of the rear connecting portion 70 to be inserted into the front connecting portion 69 and thereby allowing the length of the assembly 10 to be varied.

Optionally a stiffener rod 72 can be inserted into as much of the hollow connecting portion 69 of the front subassembly 9 as is not actually needed to contain the connecting portion 70 of the rear subassembly 34.

Mounting of the assembly 10 to an all-terrain vehicle is preferably accomplished by placing U-bolts around the assembly 10 and a cylindrical portion of the all-terrain vehicle. For those few all-terrain vehicles not having an appropriately positioned cylindrical structure; such a structure is attached to the all-terrain vehicle with any method known in the art, such as traditional straight bolts or U bolts. Optionally, the straight bolt 100 can be used to attach the rear assembly 34 to the all-terrain vehicle.

Also optionally, the rear subassembly 34 can be removed and the front end 73 of an adapter 74 installed in the connecting portion 69 of the front subassembly 9. The rear end 75 of the adapter 74 is suitable and available for connection to the receiver in a truck or utility vehicle such as a JEEP. For use with a truck, utility vehicle, or the like, the front subassembly 9 would include an adjustable seat 76; and the engine 59 and oil tank 60 are placed in the rear of the truck, utility vehicle, or the like. A further option with this embodiment replaces the outrigger 54 on the first side 45 of the front subassembly 9 with a first extendable arm 77 and the outrigger 55 on the second side 47 of the front subassembly 9 with a second extendable arm 78. A first end 79 of the first extendable arm 77 is connected to the first side 45 of the front subassembly 9, and a second end 80 of the first extendable arm 77 is rotatably attached to one or more tow wheels 81. Similarly, a first end 82 of the second extendable arm 78 is connected to the second side 47 of the front subassembly 9; and a second end 83 of the second extendable arm 78 is rotatably attached to one or more tow wheels 81. The first side 45 of the front subassembly 9 is adapted for attachment of the first extendable arm 77, and the second side 47 of the front subassembly 9 is adapted for attachment of the second extendable arm 78. Optionally, the support wheels 11 are removed when the tow wheels 81 have been installed.

Another preferred option with the tow wheels 81 is to have a tow assembly 84. The tow assembly 84 comprises a longitudinal support 85 having a first end 86 that connects to the connecting portion 69 of the front subassembly 9 and a second end 87 having the front end 73 of the adapter 74 connected to it, preferably by being installed in it. Near the second end 87 of the longitudinal support 85 is a jack 88 connected to the longitudinal support 85. Also connected to the longitudinal support 85 is a platform 89 to hold the engine 59 and oil tank 60.

As used herein the term "preferable" or "preferably" means that a specified element or technique is more acceptable than another but not that such specified element or technique is a necessity.

Furthermore, whenever the term "wheel" is used herein, it should be understood that such wheel could be replaced with a ski.

I claim:

1. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

2. The multiple-tool attachment for vehicles as recited in claim 1, further comprising:

a tool attached to a side of said second adapter assembly selected from the group consisting of the first side and the second side of said second adapter assembly.

3. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

4. The multiple-tool attachment for vehicles as recited in claim 3, further comprising:

a tool attached to a side of said first adapter assembly selected from the group consisting of the first side and the second side of said first adapter assembly.

5. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

6. The multiple-tool attachment for vehicles as recited in claim 5, further comprising:

a tool attached to a side of said second adapter assembly selected from the group consisting of the first side and the second side of said second adapter assembly.

7. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

8. The multiple-tool attachment for vehicles as recited in claim 7, further comprising:

a tool attached to a side of said first adapter assembly selected from the group consisting of the first side and the second side of said first adapter assembly.

9. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

10. The multiple-tool attachment for vehicles as recited in claim 9, further comprising:

a tool attached to a side of said second adapter assembly selected from the group consisting of the first side and the second side of said second adapter assembly.

11. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

12. The multiple-tool attachment for vehicles as recited in claim 11, further comprising:

a tool attached to a side of said first adapter assembly selected from the group consisting of the first side and the second side of said first adapter assembly.

13. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

14. The multiple-tool attachment for vehicles as recited in claim 13, further comprising:

a tool attached to a side of said second adapter assembly selected from the group consisting of the first side and the second side of said second adapter assembly.

15. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

16. The multiple-tool attachment for vehicles as recited in claim 15, further comprising:

a tool attached to a side of said first adapter assembly selected from the group consisting of the first side and the second side of said first adapter assembly.

17. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly; and a rear subassembly, comprising:

an elongate member having a first end that constitutes a connecting portion and also having a second end; and a slip joint connected to the connecting portion of said rear subassembly and to the connecting portion of said front subassembly.

18. The multiple-tool attachment for vehicles as recited in claim 17, further comprising:

a first support wheel;

a second support wheel;

a first arm having a first end rotatably attached to said first support wheel and having a second end attached to the first side of said front subassembly, wherein the first side of said front subassembly is adapted for attachment of said first arm; and a second arm having a first end rotatably attached to said second support wheel and having a second end attached to the second side of said front subassembly, wherein the second side of said front subassembly is adapted for attachment of said second arm.

19. The multiple-tool attachment for vehicles as recited in claim 18, further comprising:

a first outrigger removably attached to the first side of said front subassembly, wherein the first side of said front subassembly is adapted for connection of said first outrigger; and a second outrigger removably attached to the second side of said front subassembly, wherein the second side of said front subassembly is adapted for connection of said second outrigger.

20. The multiple-tool attachment for vehicles as recited in claim 19, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

21. The multiple-tool attachment for vehicles as recited in claim 20, further comprising:

a tool attached to a side of said second adapter assembly selected from the group consisting of the first side and the second side of said second adapter assembly.

22. The multiple-tool attachment for vehicles as recited in claim 19, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

23. The multiple-tool attachment for vehicles as recited in claim 22, further comprising:

a tool attached to a side of said first adapter assembly selected from the group consisting of the first side and the second side of said first adapter assembly.

24. The multiple-tool attachment for vehicles as recited in claim 18, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

25. The multiple-tool attachment for vehicles as recited in claim 24, further comprising:

a tool attached to a side of said second adapter assembly selected from the group consisting of the first side and the second side of said second adapter assembly.

26. The multiple-tool attachment for vehicles as recited in claim 18, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

27. The multiple-tool attachment for vehicles as recited in claim 26, further comprising:

a tool attached to a side of said first adapter assembly selected from the group consisting of the first side and the second side of said first adapter assembly.

28. The multiple-tool attachment for vehicles as recited in claim 17, further comprising:

a first outrigger removably attached to the first side of said front subassembly, wherein the first side of said front subassembly is adapted for connection of said first outrigger; and a second outrigger removably attached to the second side of said front subassembly, wherein the second side of said front subassembly is adapted for connection of said second outrigger.

29. The multiple-tool attachment for vehicles as recited in claim 28, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

30. The multiple-tool attachment for vehicles as recited in claim 29, further comprising:

a tool attached to a side of said second adapter assembly selected from the group consisting of the first side and the second side of said second adapter assembly.

31. The multiple-tool attachment for vehicles as recited in claim 28, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

32. The multiple-tool attachment for vehicles as recited in claim 31, further comprising:

a tool attached to a side of said first adapter assembly selected from the group consisting of the first side and the second side of said first adapter assembly.

33. The multiple-tool attachment for vehicles as recited in claim 17, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

34. The multiple-tool attachment for vehicles as recited in claim 33, further comprising:

a tool attached to a side of said second adapter assembly selected from the group consisting of the first side and the second side of said second adapter assembly.

35. The multiple-tool attachment for vehicles as recited in claim 17, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

36. The multiple-tool attachment for vehicles as recited in claim 35, further comprising:

a tool attached to a side of said first adapter assembly selected from the group consisting of the first side and the second side of said first adapter assembly.

37. The multiple-tool attachment for vehicles as recited in claim 17, further comprising:

one or more rear support wheels rotatably attached to said elongate member comprising said rear subassembly.

38. The multiple-tool attachment for vehicles as recited in claim 37, further comprising:

a first support wheel;

a second support wheel;

a first arm having a first end rotatably attached to said first support wheel and having a second end attached to the first side of said front subassembly, wherein the first side of said front subassembly is adapted for attachment of said first arm; and a second arm having a first end rotatably attached to said second support wheel and having a second end attached to the second side of said front subassembly, wherein the second side of said front subassembly is adapted for attachment of said second arm.

39. The multiple-tool attachment for vehicles as recited in claim 38, further comprising:

a first outrigger removably attached to the first side of said front subassembly, wherein the first side of said front subassembly is adapted for connection of said first outrigger; and a second outrigger removably attached to the second side of said front subassembly, wherein the second side of said front subassembly is adapted for connection of said second outrigger.

40. The multiple-tool attachment for vehicles as recited in claim 39, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

41. The multiple-tool attachment for vehicles as recited in claim 40, further comprising:

a tool attached to a side of said second adapter assembly selected from the group consisting of the first side and the second side of said second adapter assembly.

42. The multiple-tool attachment for vehicles as recited in claim 39, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

43. The multiple-tool attachment for vehicles as recited in claim 42, further comprising:

a tool attached to a side of said first adapter assembly selected from the group consisting of the first side and the second side of said first adapter assembly.

44. The multiple-tool attachment for vehicles as recited in claim 38, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

45. The multiple-tool attachment for vehicles as recited in claim 44, further comprising:

a tool attached to a side of said second adapter assembly selected from the group consisting of the first side and the second side of said second adapter assembly.

46. The multiple-tool attachment for vehicles as recited in claim 38, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

47. The multiple-tool attachment for vehicles as recited in claim 46, further comprising:

a tool attached to a side of said first adapter assembly selected from the group consisting of the first side and the second side of said first adapter assembly.

48. The multiple-tool attachment for vehicles as recited in claim 37, further comprising:

a first outrigger removably attached to the first side of said front subassembly, wherein the first side of said front subassembly is adapted for connection of said first outrigger; and a second outrigger removably attached to the second side of said front subassembly, wherein the second side of said front subassembly is adapted for connection of said second outrigger.

49. The multiple-tool attachment for vehicles as recited in claim 48, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

50. The multiple-tool attachment for vehicles as recited in claim 49, further comprising:

a tool attached to a side of said second adapter assembly selected from the group consisting of the first side and the second side of said second adapter assembly.

51. The multiple-tool attachment for vehicles as recited in claim 48, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

52. The multiple-tool attachment for vehicles as recited in claim 51, further comprising:

a tool attached to a side of said first adapter assembly selected from the group consisting of the first side and the second side of said first adapter assembly.

53. The multiple-tool attachment for vehicles as recited in claim 37, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

54. The multiple-tool attachment for vehicles as recited in claim 53, further comprising:

a tool attached to a side of said second adapter assembly selected from the group consisting of the first side and the second side of said second adapter assembly.

55. The multiple-tool attachment for vehicles as recited in claim 37, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

56. The multiple-tool attachment for vehicles as recited in claim 55, further comprising:

a tool attached to a side of said first adapter assembly selected from the group consisting of the first side and the second side of said first adapter assembly.

57. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

58. The multiple-tool attachment for vehicles as recited in claim 57, further comprising:

a tool attached to a side of said second adapter assembly selected from the group consisting of the first side and the second side of said second adapter assembly.

59. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

60. The multiple-tool attachment for vehicles as recited in claim 59, further comprising:

a tool attached to a side of said first adapter assembly selected from the group consisting of the first side and the second side of said first adapter assembly.

61. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

62. The multiple-tool attachment for vehicles as recited in claim 61, further comprising:

a tool attached to a side of said second adapter assembly selected from the group consisting of the first side and the second side of said second adapter assembly.

63. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

64. The multiple-tool attachment for vehicles as recited in claim 63, further comprising:

a tool attached to a side of said first adapter assembly selected from the group consisting of the first side and the second side of said first adapter assembly.

65. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

a first outrigger removably attached to the first side of said front subassembly, wherein the first side of said front subassembly is adapted for connection of said first outrigger; and a second outrigger removably attached to the second side of said front subassembly, wherein the second side of said front subassembly is adapted for connection of said second outrigger.

66. The multiple-tool attachment for vehicles as recited in claim 65, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

67. The multiple-tool attachment for vehicles as recited in claim 66, further comprising:

a tool attached to a side of said second adapter assembly selected from the group consisting of the first side and the second side of said second adapter assembly.

68. The multiple-tool attachment for vehicles as recited in claim 65, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

69. The multiple-tool attachment for vehicles as recited in claim 68, further comprising:

a tool attached to a side of said first adapter assembly selected from the group consisting of the first side and the second side of said first adapter assembly.

70. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

71. The multiple-tool attachment for vehicles as recited in claim 70, further comprising:

a tool attached to a side of said second adapter assembly selected from the group consisting of the first side and the second side of said second adapter assembly.

72. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

73. The multiple-tool attachment for vehicles as recited in claim 72, further comprising:

a tool attached to a side of said first adapter assembly selected from the group consisting of the first side and the second side of said first adapter assembly.

74. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

a first extendable arm having a first end attached to the first side of said front subassembly, wherein the first side of said front subassembly is adapted for attachment of said first extendable arm, and said first extendable arm also having a second end;

a second extendable arm having a first end attached to the second side of said front subassembly, wherein the second side of said front subassembly is adapted for attachment of said second extendable arm, and said second extendable arm also having a second end;

a tow wheel rotatably attached to the second end of said first extendable arm; and a tow wheel rotatably attached to the second end of said second extendable arm.

75. The multiple-tool attachment for vehicles as recited in claim 74, further comprising:

a first support wheel;

second support wheel;

a first arm having a first end rotatably attached to said first support wheel and having a second end attached to the first side of said front subassembly, wherein the first side of said front subassembly is adapted for attachment of said first arm; and a second arm having a first end rotatably attached to said second support wheel and having a second end attached to the second side of said front subassembly, wherein the second side of said front subassembly is adapted for attachment of said second arm.

76. The multiple-tool attachment for vehicles as recited in claim 75, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

77. The multiple-tool attachment for vehicles as recited in claim 76, further comprising:

a tool attached to a side of said second adapter assembly selected from the group consisting of the first side and the second side of said second adapter assembly.

78. The multiple-tool attachment for vehicles as recited in claim 75, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

79. The multiple-tool attachment for vehicles as recited in claim 78, further comprising:

a tool attached to a side of said first adapter assembly selected from the group consisting of the first side and the second side of said first adapter assembly.

80. The multiple-tool attachment for vehicles as recited in claim 74, further comprising:

an inner section of a boom having a second end attached to the front of said front subassembly in such a manner that said inner section can be rotated in both the pitch axis and the yaw axis; and a second adapter assembly having a first side and a second side available for connecting to tools and having a third side connected to a first end of said inner section of a boom.

81. The multiple-tool attachment for vehicles as recited in claim 80, further comprising:

a tool attached to a side of said second adapter assembly selected from the group consisting of the first side and the second side of said second adapter assembly.

82. The multiple-tool attachment for vehicles as recited in claim 74, further comprising:

an inner section of a boom having a second end attached to the front of said front subassembly in such a manner that said inner section can be rotated in both the pitch axis and the yaw axis;

an outer section of a boom having a second end pivotally attached to a first end of said inner section; and a first adapter assembly having a first side and a second side available for connecting to tools and having a third side connected to a first end of said outer section of a boom.

83. The multiple-tool attachment for vehicles as recited in claim 82, further comprising:

a tool attached to a side of said first adapter assembly selected from the group consisting of the first side and the second side of said first adapter assembly.

84. The multiple-tool attachment for vehicles as recited in claim 74, further comprising:

a tow assembly inserted between the connecting portion of said front subassembly and said adapter, said tow assembly comprising:

a longitudinal support having a first end attached to the connecting portion of said front subassembly and having a second end having the front end of said adapter connected to it;

a jack connected to said longitudinal support near the second end of said longitudinal support; and a platform connected to said longitudinal support.

85. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis;

a second adapter assembly having a first side and a second side available for connecting to tools and having a third side connected to a first end of said inner section of a boom; and a tool attached to a side of said second adapter assembly selected from the group consisting of the first side and the second side of said second adapter assembly.

86. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis;

an outer section of a boom having a second end pivotally attached to a first end of said inner section;

a first adapter assembly having a first side and a second side available for connecting to tools and having a third side connected to a first end of said outer section of a boom; and a tool attached to a side of said first adapter assembly selected from the group consisting of the first side and the second side of said first adapter assembly.

87. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly; a rear subassembly, comprising:

an elongate member having a first end that constitutes a connecting portion and also having a second end;

a slip joint connected to the connecting portion of said rear subassembly and to the connecting portion of said front subassembly;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis;

a second adapter assembly having a first side and a second side available for connecting to tools and having a third side connected to a first end of said inner section of a boom; and a tool attached to a side of said second adapter assembly selected from the group consisting of the first side and the second side of said second adapter assembly.

88. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

a rear subassembly, comprising:

an elongate member having a first end that constitutes a connecting portion and also having a second end;

a slip joint connected to the connecting portion of said rear subassembly and to the connecting portion of said front subassembly;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis;

an outer section of a boom having a second end pivotally attached to a first end of said inner section;

a first adapter assembly having a first side and a second side available for connecting to tools and having a third side connected to a first end of said outer section of a boom; and a tool attached to a side of said first adapter assembly selected from the group consisting of the first side and the second side of said first adapter assembly.

89. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

a rear subassembly, comprising:

an elongate member having a first end that constitutes a connecting portion and also having a second end;

a slip joint connected to the connecting portion of said rear subassembly and to the connecting portion of said front subassembly;

one or more rear support wheels rotatably attached to said elongate member comprising said rear subassembly;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis;

a second adapter assembly having a first side and a second side available for connecting to tools and having a third side connected to a first end of said inner section of a boom; and a tool attached to a side of said second adapter assembly selected from the group consisting of the first side and the second side of said second adapter assembly.

90. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

a rear subassembly, comprising:

an elongate member having a first end that constitutes a connecting portion and also having a second end;

a slip joint connected to the connecting portion of said rear subassembly and to the connecting portion of said front subassembly;

one or more rear support wheels rotatably attached to said elongate member comprising said rear subassembly;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis;

an outer section of a boom having a second end pivotally attached to a first end of said inner section;

a first adapter assembly having a first side and a second side available for connecting to tools and having a third side connected to a first end of said outer section of a boom; and a tool attached to a side of said first adapter assembly selected from the group consisting of the first side and the second side of said first adapter assembly.

91. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis;

a second adapter assembly having a first side and a second side available for connecting to tools and having a third side connected to a first end of said inner section of a boom; and a tool attached to a side of said second adapter assembly selected from the group consisting of the first side and the second side of said second adapter assembly.

92. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

a first outrigger removably attached to the first side of said front subassembly, wherein the first side of said front subassembly is adapted for connection of said first outrigger;

a second outrigger removably attached to the second side of said front subassembly, wherein the second side of said front subassembly is adapted for connection of said second outrigger;

an inner section of a boom having a second end attached to the front of said front subassembly in such a manner that said inner section can be rotated in both the pitch axis and the yaw axis;

an outer section of a boom having a second end pivotally attached to a first end of said inner section;

a first adapter assembly having a first side and a second side available for connecting to tools and having a third side connected to a first end of said outer section of a boom; and a tool attached to a side of said first adapter assembly selected from the group consisting of the first side and the second side of said first adapter assembly.

93. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

a first extendable arm having a first end attached to the first side of said front subassembly, wherein the first side of said front subassembly is adapted for attachment of said first extendable arm, and said first extendable arm also having a second end;

a second extendable arm having a first end attached to the second side of said front subassembly, wherein the second side of said front subassembly is adapted for attachment of said second extendable arm, and said second extendable arm also having a second end;

a tow wheel rotatably attached to the second end of said first extendable arm;

a tow wheel rotatably attached to the second end of said second extendable arm;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

an inner section of a boom having a second end attached to the front of said front subassembly in such a manner that said inner section can be rotated in both the pitch axis and the yaw axis;

a second adapter assembly having a first side and a second side available for connecting to tools and having a third side connected to a first end of said inner section of a boom; and a tool attached to a side of said second adapter assembly selected from the group consisting of the first side and the second side of said second adapter assembly.

94. A multiple-tool attachment for vehicles, which comprises:

a front subassembly, comprising:

a longitudinal elongate member having a first end that constitutes a front of the front subassembly and that is adapted for attachment of a boom and also having a second end that constitutes a connecting portion; and a cross member running across and attached to said longitudinal elongate member, said cross member having a first end that constitutes a first side of the front subassembly and also having a second end that constitutes a second side of the front subassembly;

an adapter having a front end attached to the connecting portion of said front subassembly and having a rear end suitable and available for connection to the receiver in a truck or utility vehicle;

a first extendable arm having a first end attached to the first side of said front subassembly, wherein the first side of said front subassembly is adapted for attachment of said first extendable arm, and said first extendable arm also having a second end;

a second extendable arm having a first end attached to the second side of said front subassembly, wherein the second side of said front subassembly is adapted for attachment of said second extendable arm, and said second extendable arm also having a second end;

a tow wheel rotatably attached to the second end of said first extendable arm;

a tow wheel rotatably attached to the second end of said second extendable arm;

a first support wheel;

a second support wheel;

a first arm having a first end rotatably attached to said first support wheel and having a second end attached to the first side of said front subassembly, wherein the first side of said front subassembly is adapted for attachment of said first arm;

a second arm having a first end rotatably attached to said second support wheel and having a second end attached to the second side of said front subassembly, wherein the second side of said front subassembly is adapted for attachment of said second arm;

an inner section of a boom having a second end attached to the front of said front subassembly in such a manner that said inner section can be rotated in both the pitch axis and the yaw axis;

an outer section of a boom having a second end pivotally attached to a first end of said inner section;

a first adapter assembly having a first side and a second side available for connecting to tools and having a third side connected to a first end of said outer section of a boom; and a tool attached to a side of said first adapter assembly selected from the group consisting of the first side and the second side of said first adapter assembly.

* * * * *